US006357056B2

(12) United States Patent
Jermier

(10) Patent No.: US 6,357,056 B2
(45) Date of Patent: Mar. 19, 2002

(54) WATER SAVING TOILET SYSTEM

(75) Inventor: Donald A. Jermier, Stamford, CT (US)

(73) Assignee: Control Fluidics, Inc., Staten Island, NY (US)

( * ) Notice: Subject to any disclaimer, the term of this patent is extended or adjusted under 35 U.S.C. 154(b) by 0 days.

(21) Appl. No.: 09/552,169

(22) Filed: Apr. 18, 2000

(51) Int. Cl.[7] ..... E03D 9/10
(52) U.S. Cl. ..... 4/319; 4/431; 4/441
(58) Field of Search ..... 4/319, 320, 321, 4/323, 431, 441

(56) References Cited

U.S. PATENT DOCUMENTS

| | | | | | |
|---|---|---|---|---|---|
| 4,333,185 A | | 6/1982 | Heinze et al. | ..... | 4/319 |
| 4,516,280 A | | 5/1985 | Tufts | ..... | 4/319 |
| 4,516,281 A | * | 5/1985 | MacPherson et al. | ..... | 4/319 |
| 4,550,452 A | * | 11/1985 | Tufts | ..... | 4/319 |
| 4,672,689 A | | 6/1987 | Heinze et al. | ..... | 4/320 |
| 5,036,554 A | | 8/1991 | Blount | ..... | 4/323 |
| 5,542,132 A | | 8/1996 | Jaeckels et al. | ..... | 4/313 |
| 5,608,923 A | | 3/1997 | Jaeckels et al. | ..... | 4/325 |
| 5,729,837 A | | 3/1998 | Jaeckels et al. | ..... | 4/223 |

* cited by examiner

*Primary Examiner*—Robert M. Fetsuga
*Assistant Examiner*—Kathleen J. Prunner
(74) *Attorney, Agent, or Firm*—Banner & Witcoff, Ltd.

(57) ABSTRACT

A toilet system having a toilet bowl including at a bottom thereof a discharge opening. The discharge opening of the bowl is connected to the intake opening of a treating chamber. A discharge pump in the treating chamber discharges treated effluent therefrom to a waste pipe. A conduit free of bends along its length connects the discharge pump to the waste pipe.

6 Claims, 6 Drawing Sheets

WATER SAVING TOILET SYSTEM

INTRODUCTION

The present invention is directed to a water saving toilet system, and, more particularly, to a water saving toilet system having an improved discharge piping construction.

BACKGROUND

In U.S. Pat. No. 4,516,280, dated May 14, 1985, there is shown and described a water saving toilet system. The system herein illustrated is similar in many respects to that shown in the aforesaid patent, but improved in certain aspects, particularly in that it is provided with improved construction to reduce the chance of clogging at the discharge of the pump, and an improved controller to better optimize the timing of various functions of the toilet system.

It is an object of the present invention to provide a water saving toilet system which reduces or wholly overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of preferred embodiments.

SUMMARY

The principles of the invention may be used to advantage to provide a toilet system having improved flow of effluent from a discharge pump to a waste pipe, reducing the possibility of clogging within the toilet system.

In accordance with a first aspect, a toilet system comprises a toilet bowl having at a bottom thereof a discharge opening. The discharge opening of the bowl is connected to an intake opening of a treating chamber. A discharge pump in the treating chamber discharges treated effluent therefrom to a waste pipe. A conduit free of bends along its length connects the discharge pump to the waste pipe.

From the foregoing disclosure, it will be readily apparent to those skilled in the art, that is, those who are knowledgeable or experienced in this area of technology, that the present invention provides a significant advance. Preferred embodiments of the toilet system of the present invention can provide improved flow characteristics of treated effluent. These and additional features and advantages of the invention disclosed here will be further understood from the following detailed disclosure of preferred embodiments.

BRIEF DESCRIPTION OF THE DRAWINGS

Preferred embodiments are described in detail below with reference to the appended drawings.

Figure 1:
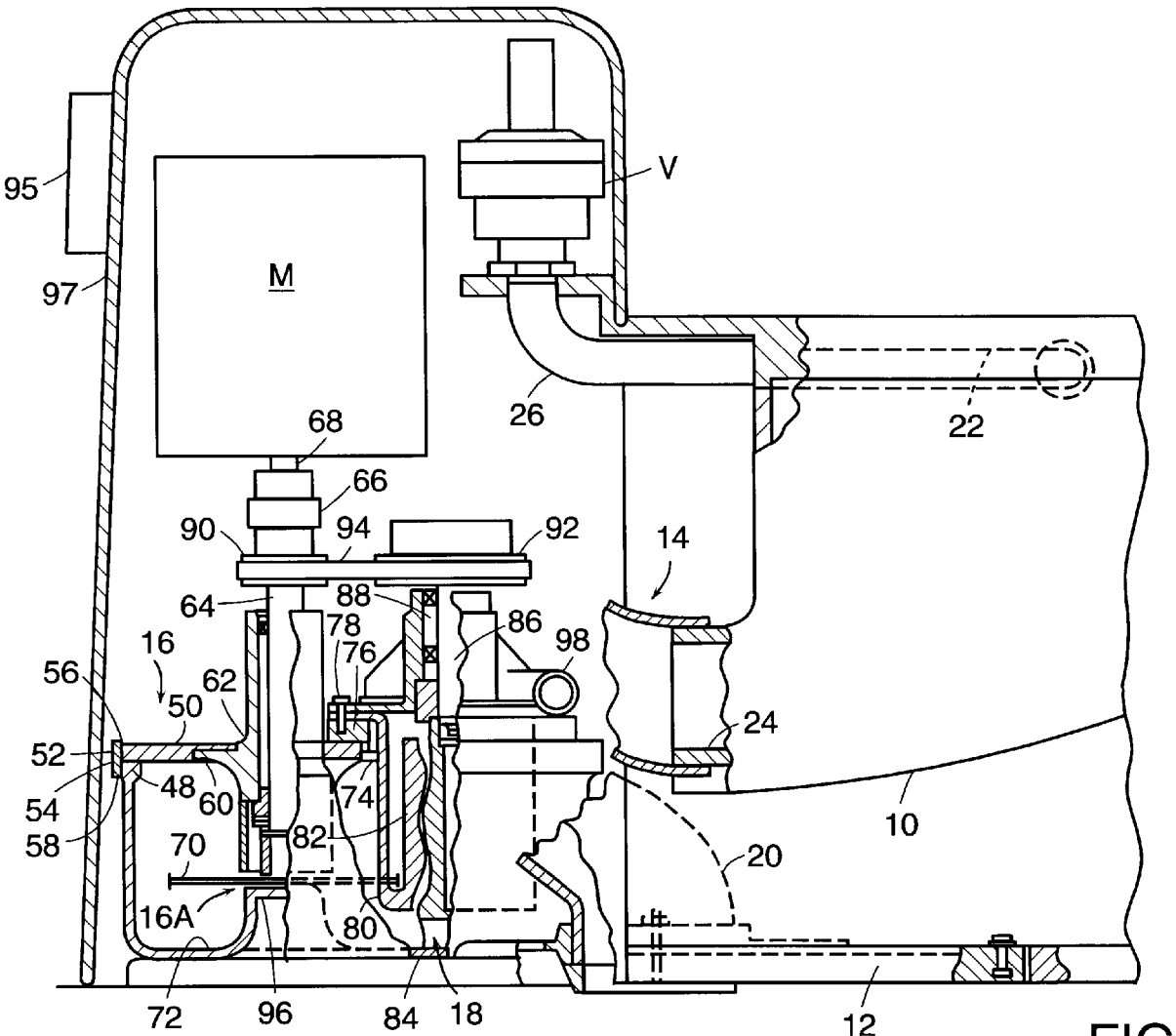
FIG. 1 is a side elevation partly in section of the toilet system of the present invention.

The figures referred to above are not drawn necessarily to scale and should be understood to present a representation of the invention, illustrative of the principles involved. Some features of the water saving toilet system depicted in the drawings have been enlarged or distorted relative to others to facilitate explanation and understanding. The same reference numbers are used in the drawings for similar or identical components and features shown in various alternative embodiments. Water saving toilet systems as disclosed herein, will have configurations and components determined, in part, by the intended application and environment in which they are used.

DETAILED DESCRIPTION OF PREFERRED EMBODIMENTS

Referring to the drawings, in FIG. 1 there is shown a toilet bowl 10 supported on a suitable base 12, to which flush water is supplied by a solenoid-operated valve V and from which effluent is discharged through a trap 14 into a treating chamber 16 where it is macerated by a macerator 16A and then pumped by means of a pump 18 through a waste pipe 20 to a soil pipe.

Figure 2:
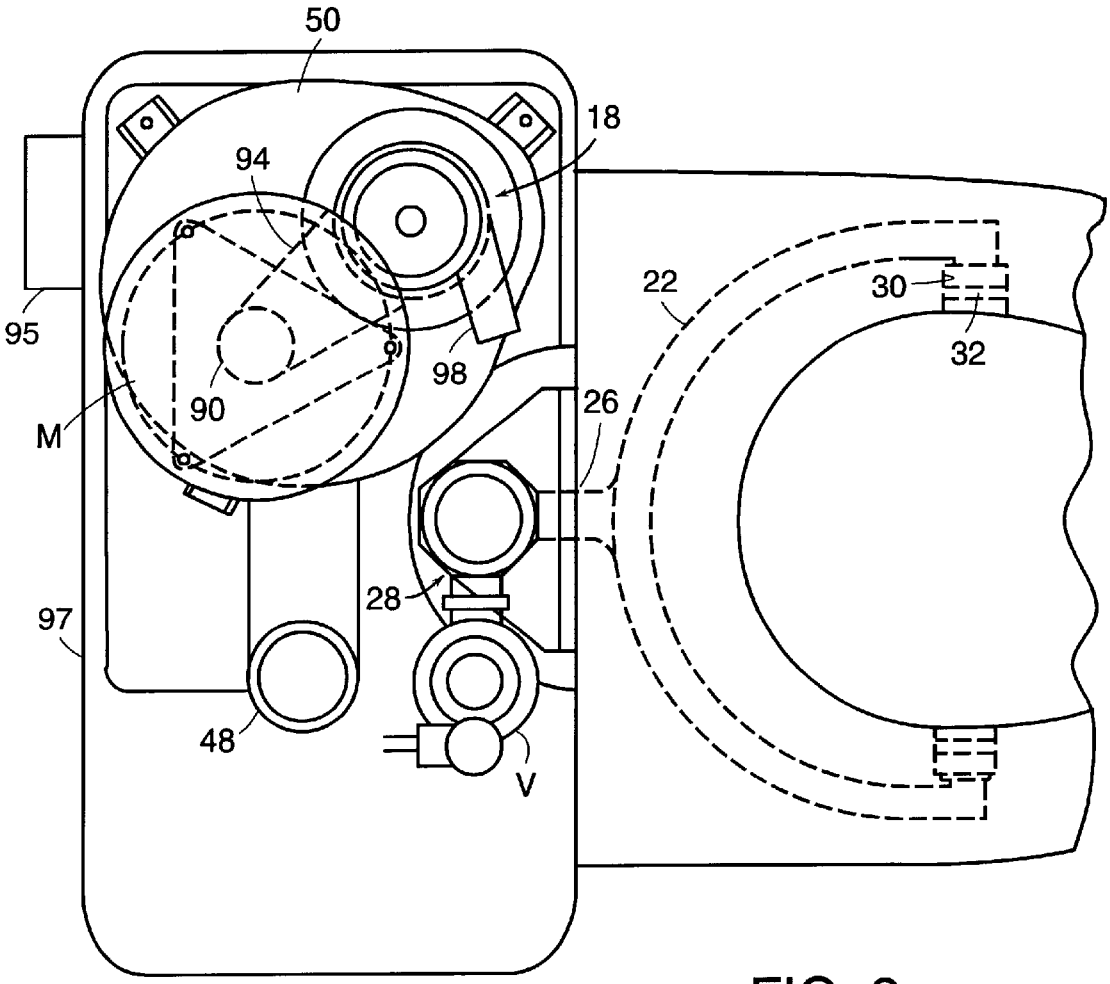
FIG. 2 is a top plan view of the toilet system of FIG. 1.
Figure 2A:
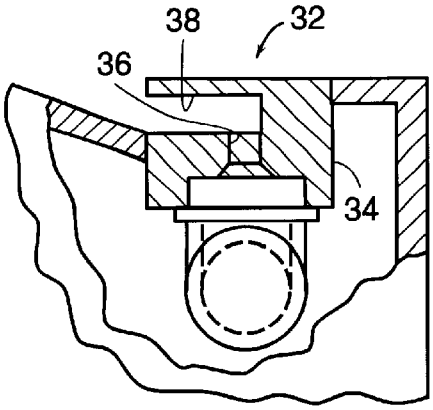
FIG. 2A is a fragmentary section of a spray head nozzle of the toilet system of FIG. 1.

The toilet bowl 10 is of generally conventional configuration, has at the top a cored passage 22 which, as shown in FIG. 2, extends peripherally around the rear half of the bowl, through which flush water is delivered to the bowl for flushing, and a discharge opening 24 at the bottom through which effluent is discharged. The rear end of the cored passage is connected by a feeder tube 26 and suitable plumbing 28 to the valve V which, in turn, is connected to a water supply, not shown, so that operation of the valve will supply flush water to the cored passage. The forward ends of the cored passage terminate diametrically opposite each other approximately halfway between the front and rear ends of the bowl in openings 30 within which there are fixed spray nozzles 32 through which water delivered into the cored passage is ejected downwardly on the surface of the bowl. The nozzles 32 comprise, FIG. 2A, cylindrical plugs 34 containing ports 36 which are in communication with the cored passage 22 and downwardly-open slots 38 designed to eject the flush water downwardly in fan shape against the surface of the bowl so as to wash the surface down.

Figure 5:
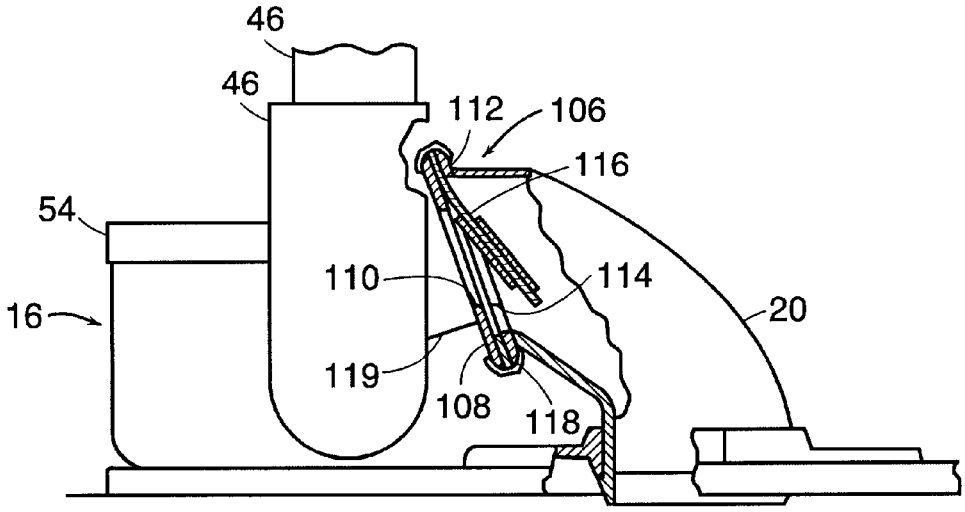
FIG. 5 is an elevation of the treating chamber of FIG. 1, showing the bypass conductor partly in section.

The trap 14 for conducting the effluent from the bowl to the treating chamber, as shown in FIG. 5, has an upwardly-inclined leg 40, the lower end of which is flanged at 42 to fit over an extension 44 defining the opening 24, and a vertical leg 46 connected at its upper end to the inclined leg 40 and at its lower end to the treating tank 16.

As seen in FIG. 1, the treating chamber 16 is mounted on the supporting structure for the bowl behind the bowl, is of generally circular cross section, is closed at the bottom, and has an open top, peripherally of which there is a beveled rim 48. A cover plate 50 having a beveled edge 52 is mounted on the rim 48 and detachably secured thereto by a locking band 54, the upper and lower edges 56 and 58 of which overlap the beveled portions of the rim and edge. The locking band 54 provides for easy removal of the cover plate from the treating chamber. The cover plate supports the macerator 16A, the pump 18 and the drive means therefore. To this end, the cover plate 50 is provided with a top opening 60 in which there is mounted a vertical bearing assembly 62 which supports a shaft 64 in a vertical position with a portion extending above the treating chamber and a portion extending into the treating chamber. The portion of the shaft 64 extending above the treating chamber is fixed by a coupling 66 to the drive shaft 68 of a motor M. The portion of the shaft 64 extending into the treating chamber has fixed to it a macerator blade 70 disposed in a horizontal position at right angles to the axis of the shaft. Below the macerator blade, the bottom of the treating chamber is structured to provide an annular toroidal surface 72. The blade 70 and the subjacent toroidal surface 72 provide for hydraulic attrition of effluent delivered into the treating chamber. The macerator operates by hydraulic attrition rather than cutting to disperse and particulate the solids in the effluent.

The cover plate 50 is also provided with an opening 74 for receiving the pump assembly 18 and the latter is mounted in the opening by means of a ring 76 fastened by bolts 78 to the top plate and comprises a sealed housing 80 within which there is a stator 82 and a rotor 84. The upper end of the rotor is fixed to a shaft 86 journaled in a bearing 88 mounted on the ring 76. The stator 82 and rotor 84 constitute, in conjunction, a worm pump.

A pulley 90 is fixed to the upper end of the shaft 64, a pulley 92 is fixed to the upper end of the shaft 86, and a belt 94 is trained about pulleys 90, 92 so that the motor M drives the macerator and the pump simultaneously. A control module 95 is mounted at the back of a housing 97 of the toilet system.

Figure 3:
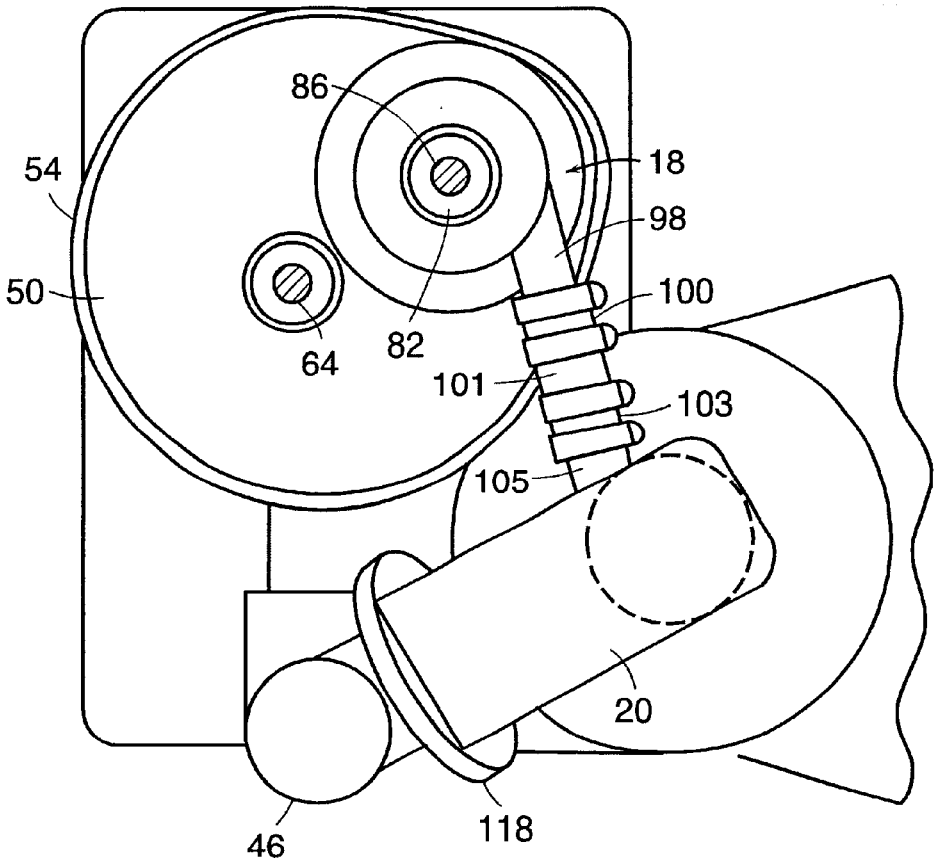
FIG. 3 is a plan view, of the treating chamber of the toilet system of FIG. 1, showing a bypass conductor and a conduit connecting the pump to the bypass conductor.
Figure 4:
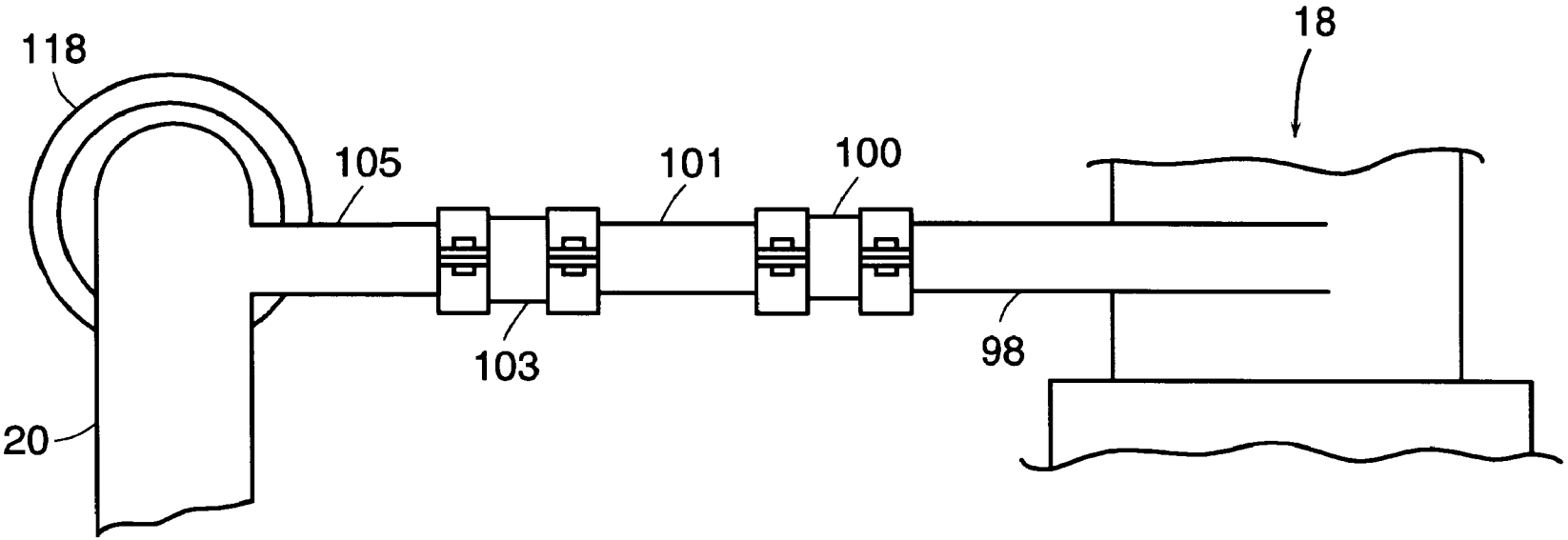
FIG. 4 is an elevation view of the conduit of FIG. 3.
Figure 6:
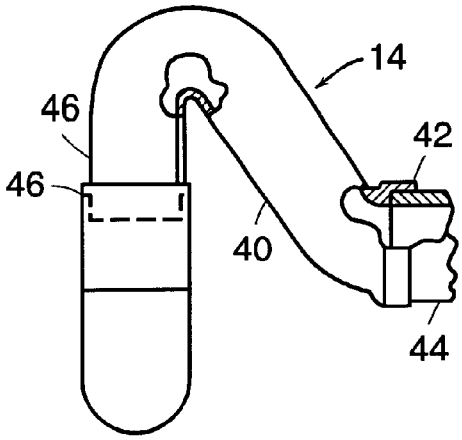
FIG. 6 is a fragmentary elevation, with a portion in section, of a trap pipe of the toilet system of FIG. 1 connecting the bowl to the treating chamber.
Figure 7:
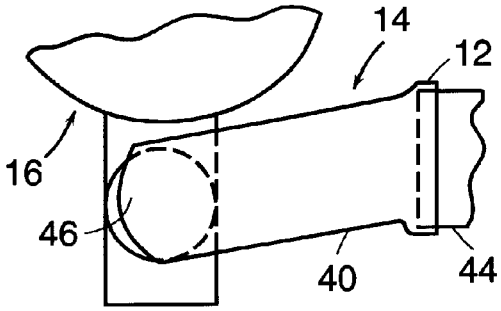
FIG. 7 is a top view of the trap pipe of FIG. 6.

The pump 18 has an intake port 96 within treating chamber 16 and a discharge port 98 externally of the treating chamber. Discharge port 98 is connected by a coupling 100 to a length of pipe 101, as seen in FIGS. 3 and 4, which is in turn connected by a coupling 103 to an inlet port 105 on waste pipe 20 which, as previously mentioned, is connected to a soil pipe. The combination of discharge port 98, pipe 101, and inlet port 105 are coaxial such that discharge from pump 18 flows in a straight line to waste pipe 20, reducing the chance of blockage as effluent is discharged from pump 18. Thus, effluent flows from pump 18 in an improved manner through a conduit, free of bends along its length, to waste pipe 20, the conduit being formed, in a preferred embodiment, of discharge port 98, pipe 101, and inlet port 105, connected to one another by couplings. This alleviates a problem encountered in prior art systems wherein effluent exiting the discharge port encountered a first 90° elbow, flowed downwardly, and then encountered a second 90° elbow before entering the waste pipe in horizontal fashion. When large amounts of waste and paper were flushed through such a configuration, the discharge force of the pump caused the waste and paper to impact the 90° elbows and lead to plugging of the system. To clear such clogs is a difficult and time consuming process, and includes dismantling a major portion of the system. Consequently, the improved flow of effluent from the pump to waste pipe 20 of the present invention realizes a significant improvement in the operation and efficiency of the toilet system.

As shown in FIGS. 3 and 5, the waste pipe 20 is connected at one end directly to the vertical leg of the trap by means of a valve assembly 106 comprising a beveled plate 108 which defines an opening 110, a plate 112 which defines an opening 114 and a flexible valve member 116 positioned therebetween and clamped in place by a circumferential clamping ring 118. The plate 108 is fixed to a branch pipe 119 stemming from the leg 46, the axis of which is inclined upwardly with respect to the vertical axis of the leg 46 so that the plate 108 slopes downwardly at a diverging angle with respect to the axis of the vertical leg. The plate 112 is fixed to the waste pipe 20 at an angle such as to be parallel to the plate 108. As thus constructed, the valve assembly slopes downwardly and divergently with respect to the axis of the vertical leg of the trap. The flexible valve member 116 is arranged to open inwardly with respect to the waste pipe 20 by a pressure head within the vertical leg of the trap and to close by gravity in the absence of a head in the vertical portion of the trap. Normally, when the pump is in operation, it produces a low pressure in the vertical leg of the trap so that the low pressure, in conjunction with the gravitational disposition of the valve member 116, ensures that the valve will be held closed under normal conditions. An angular disposition of the valve is of importance to prevent siphoning of the effluent from the vertical leg of the trap when the system is at rest. When the system is in use and, for some reason, the pump becomes disabled, a pressure head developed in the vertical leg of the trap will open the valve 116 and allow the effluent to flow directly through the waste pipe 20 to the soil pipe. The pressure head can be provided by dumping water into the bowl or, if the valve V is operative, supplying water to the bowl through the valve.

Figure 8:
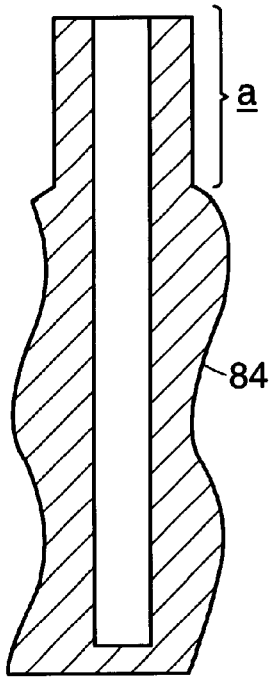
FIG. 8 is a plan view in section of the pump rotor of the pump of the toilet system of FIG. 1.

In prior toilet systems of this kind, diaphragm and gear pumps have been used for effecting discharge of effluent. However, in accordance with this invention, it has been found that a screw pump is considerably more satisfactory and effective insofar as the flush cycle is concerned. The stator 82 is comprised of flexible rubber and the rotor is plastic. In order to reduce the friction load of the plastic rotor in the flexible rubber stator, a portion of the worm at one end has been reduced to the root diameter of the worm. As herein illustrated, FIG. 8, the rotor 84, which is comprised of Bakelite, is 4.28 inches axial length. The diameter of the worm is 1.12 inches and has a helix angle of 25 degrees with a lead of 1.648 and at one end a portion a 1.12 inches in length reduced to a uniform diameter of 0.0875 inches. By reducing the portion a at the one end to the root diameter of the worm, the friction between the rotor and stator can be materially reduced, thus reducing the power input necessary to drive the pump.

A flushing cycle of the toilet system in normal operation is sequenced by the control circuitry of control module 95 so that motor M is started first, simultaneously driving macerator 16A and discharge pump 18, followed by energization of a solenoid to open the valve V for supplying flush water to the bowl. In a preferred embodiment, the bowl is flushed with 2 and ½ quarts of water during the flushing cycle. While the valve is still open and flushing is still occurring, the discharge pump 18 stops. The flushing operation is subsequently stopped by closing of the valve V. Macerator 16A is in operation during the entire time that discharge pump 18 is in operation.

Figure 9:
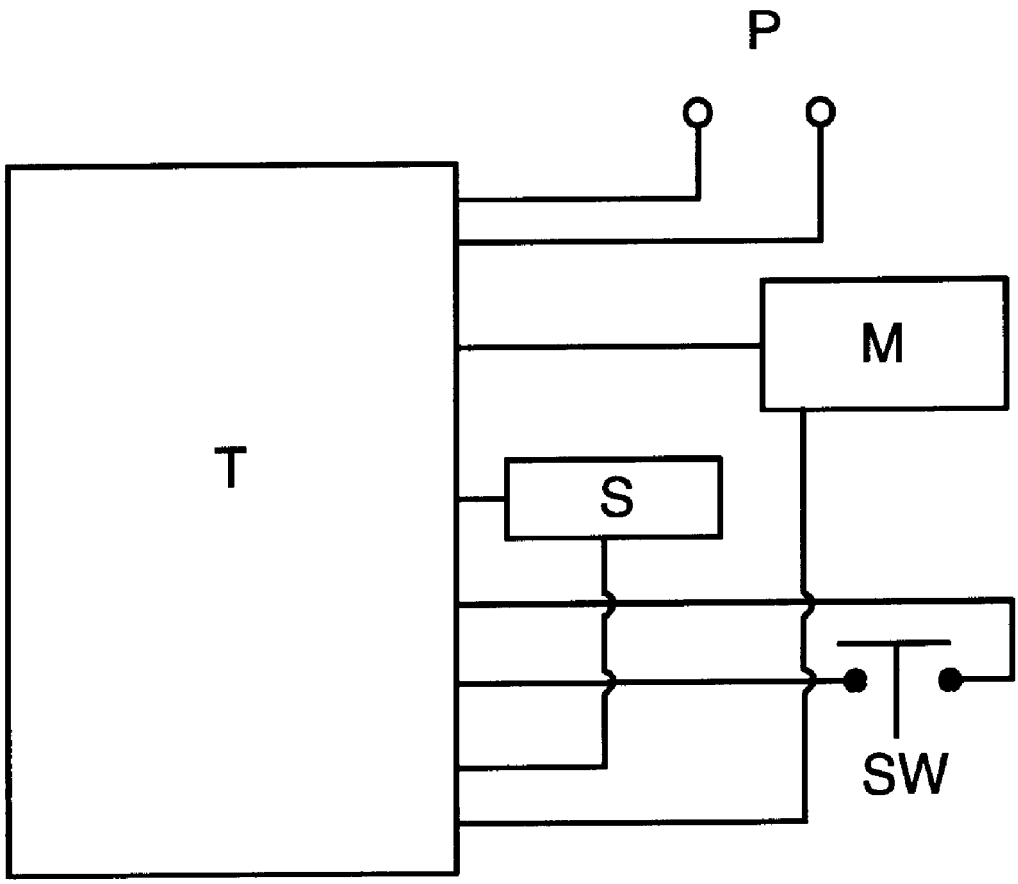
FIG. 9 is a control circuit diagram for controlling the sequence of operation of components of the toilet system of FIG. 1.

FIG. 9 is a wiring diagram showing a timer T which provides for sequencing the operation of the valve V and motor M during the flushing cycle, so as to start the motor before opening the valve and to stop the motor before closing the valve. In the circuit, there is shown a normally open switch SW for energizing the circuit, the motor M for driving the macerator and pump, a solenoid S for activating the valve V, and a timer T powered by a power source P and controlling the sequenced operation of motor M and solenoid actuated valve V. Timer T is preferably sealed in epoxy in module 95 to protect it from moisture, heat, and other environmental conditions.

In a preferred embodiment, the timing of the sequence of the steps during the flushing cycle of the system is as follows. The total operation run time of the flushing cycle is eight seconds, and during that time, timer T of the control circuit performs three separate functions. At the start of the sequence, that is, time zero, the timer first energizes motor M, which then runs for the first five seconds of the cycle and is then deenergized. The timer also provides a delay of one and a half seconds from time zero, at which time the solenoid is opened, opening valve V to provide rinsing of toilet bowl 10. The timer then provides for the solenoid and valve V to remain open until the end of the eight second run cycle. Such a combination of timing sequences has been found to be particularly advantageous. The particular timing of the components of the toilet system described herein utilizes a minimum of water to efficiently evacuate and rinse the bowl, as well as efficiently treat and discharge the waste from the toilet system. Closing the normally open switch SW during the flushing cycle preferably does not affect operation of the either of the delay cycles, that is, the first delay of 1½ seconds before the solenoid and valve open, or the second delay of 6½ seconds during which the valve remains open and the bowl is flushed.

In a preferred embodiment, timer T is calibrated to an accuracy of ±2%. Motor M preferably is a ¼ HP motor with a 20 amp in-rush, 10 amp run capacity, and in-rush time of approximately 1 second. Solenoid S preferably has a 2 amp in-rush, a 0.45 amp run capacity, and an in-rush time of approximately 0.2 seconds. The supply voltage from power source P to timer T is preferably unfiltered 115 V.A.C. at 60 Hz, with a voltage variation of ±10%, with transients not to exceed 400 volts for 1 milli-second.

It is to be appreciated that although timer T is shown here in conjunction with a specific configuration of a water saving toilet, other constructions of toilets appropriate for the use of such a timer having the performance characteristics described herein are considered within the scope of the invention.

In a preferred embodiment, the power to motor M is supplied initially to the starting circuit of the motor, preferably for approximately 400–600 milliseconds, more preferably approximately 500 milliseconds, and then the power is switched to the running circuit of motor M for the remainder of the five second period during which motor M runs. By switching power from the starting circuit to the running circuit in this manner, the expense of a separate starting switch in the motor is eliminated.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A toilet system comprising, in combination:

a toilet bowl having at a bottom thereof a discharge opening;

a treating chamber having an intake opening;

a trap connected at a first end to the discharge opening and at a second end to the intake opening;

a discharge pump in the treating chamber for discharging treated effluent therefrom;

a waste pipe for carrying treated effluent from the discharge pump;

a conduit connecting the discharge pump and the waste pipe, the conduit being free of bends along its length; and a valve connected to the trap and to the waste pipe, the valve configured to allow effluent flow from the trap to the waste pipe and to prevent effluent flow from the waste pipe to the trap.

2. The toilet system according to claim 1, wherein the conduit comprises a discharge port on the discharge pump;

an inlet port on the waste pipe; and a length of pipe connected at one end to the discharge port and at its other end to the inlet port.

3. The toilet system according to claim 2, wherein the valve is connected to the waste pipe upstream of the inlet port.

4. A toilet system comprising, in combination:

a toilet bowl having at a bottom thereof a discharge opening;

a treating chamber having an intake opening;

a trap connected at a first end to the discharge opening and at a second end to the intake opening;

a macerator in the treating chamber;

a discharge pump in the treating chamber for discharging treated effluent therefrom;

a waste pipe for carrying treated effluent from the discharge pump;

a conduit connecting the discharge pump and the waste pipe, the conduit being free of bends along its length;

a motor for operating the macerator and the discharge pump;

a valve connecting the toilet bowl to a source of water and operable to admit water to the bowl to flush the bowl; and a second valve, the second valve connected to the trap and to the waste pipe and configured to allow effluent flow from the trap to the waste pipe and to prevent effluent flow from the waste pipe to the trap.

5. The toilet system according to claim 4, wherein the conduit comprises a discharge port on the discharge pump;

an inlet port on the waste pipe; and a length of pipe connected at one end to the discharge port and at its other end to the inlet port.

6. The toilet system according to claim 5, wherein the second valve is connected to the waste pipe upstream of the inlet port.

* * * * *